US008310419B2

(12) United States Patent
Woo et al.

(10) Patent No.: US 8,310,419 B2
(45) Date of Patent: Nov. 13, 2012

(54) DISPLAY DEVICE AND DRIVING METHOD THEREOF

(75) Inventors: Doo-Hyung Woo, Anyang-si (KR); Kwang-Sub Shin, Anyang-si (KR); Young-Il Kim, Suwon-si (KR); Ji-Hye Eom, Suwon-si (KR)

(73) Assignee: Samsung Display Co., Ltd., Yongin (KR)

( * ) Notice: Subject to any disclaimer, the term of this patent is extended or adjusted under 35 U.S.C. 154(b) by 739 days.

(21) Appl. No.: 12/344,334

(22) Filed: Dec. 26, 2008

(65) Prior Publication Data

US 2009/0315815 A1 Dec. 24, 2009

(30) Foreign Application Priority Data

Jun. 23, 2008 (KR) ..... 10-2008-0059040

(51) Int. Cl.
*G09G 3/32* (2006.01)

(52) U.S. Cl. ..... 345/82; 345/76; 345/78; 345/79; 345/84; 345/92; 345/204

(58) Field of Classification Search ..... None
See application file for complete search history.

(56) References Cited

U.S. PATENT DOCUMENTS

| | | | | |
|---|---|---|---|---|
| 7,193,588 | B2 | 3/2007 | Lo | |
| 7,317,435 | B2 | 1/2008 | Hsueh | |
| 2005/0219170 | A1 | 10/2005 | Seki | |
| 2005/0225251 | A1 | 10/2005 | Tsueh | |
| 2006/0103606 | A1 | 5/2006 | Ahn | |
| 2007/0273620 | A1 * | 11/2007 | Yumoto | 345/76 |
| 2007/0273621 | A1 * | 11/2007 | Yamashita et al. | 345/76 |
| 2008/0231199 | A1 * | 9/2008 | Yamamoto et al. | 315/169.3 |
| 2009/0046088 | A1 * | 2/2009 | Asano et al. | 345/211 |

FOREIGN PATENT DOCUMENTS

| | | | |
|---|---|---|---|
| CN | 1815538 | | 8/2006 |
| CN | 1975845 | | 6/2007 |
| CN | 101271666 | | 9/2008 |
| JP | 2005134838 | | 5/2005 |
| JP | 2005164894 | * | 6/2005 |
| JP | 2005292272 | | 10/2005 |
| JP | 2005352411 | | 12/2005 |

(Continued)

*Primary Examiner* — Joseph Haley
*Assistant Examiner* — Ifedayo Iluyomade
(74) *Attorney, Agent, or Firm* — H.C. Park & Associates, PLC

(57) ABSTRACT

The present invention relates to a display device and a driving method thereof. The display device includes a light emitting device, a capacitor connected between a first electrical contact and a second electrical contact, a driving transistor, a switching transistor being controlled by a scanning signal to be connected between a data voltage and the first electrical contact, a first compensation transistor being controlled by a first compensation signal to be connected between the first electrical contact and a first voltage, and a second compensation transistor being controlled by a second compensation signal to be connected between the second electrical contact and a second voltage. The driving transistor includes an input terminal that is connected to a driving voltage, an output terminal that is connected to the second electrical contact, and a control terminal that is connected to the first electrical contact.

23 Claims, 8 Drawing Sheets

FOREIGN PATENT DOCUMENTS

| | | |
|---|---|---|
| JP | 2007101798 | 4/2007 |
| JP | 2007108379 | 4/2007 |
| JP | 2007179066 | 7/2007 |
| KR | 100370286 | 1/2003 |
| KR | 100469347 | 1/2005 |
| KR | 1020050117368 | 12/2005 |
| KR | 1020060014966 | 2/2006 |
| KR | 100687356 | 2/2007 |
| KR | 100762138 | 9/2007 |
| KR | 102008002011 | 1/2008 |

* cited by examiner

DISPLAY DEVICE AND DRIVING METHOD THEREOF

CROSS-REFERENCE TO RELATED APPLICATION

This application claims priority to and the benefit of Korean Patent Application No. 10-2008-0059040, filed on Jun. 23, 2008, which is hereby incorporated by reference for all purposes as if fully set forth herein.

BACKGROUND OF THE INVENTION

1. Field of the Invention

The present invention relates to a display device and a driving method thereof, and more particularly, to an organic light emitting device and a driving method thereof.

2. Discussion of the Background

A hole-type flat panel display such as an organic light emitting device displays a fixed image for a predetermined period of time, such as a single frame time. For example, when displaying a continuously moving object, the motion of an object may be discretely displayed in such a manner that the object stops in a particular location for a single frame and then stops in the next location for the next frame after a single frame time elapses. Since the time of the single frame is within a time when an afterimage is maintained, the object's motion may be displayed as continuous using the above scheme.

However, when viewing a continuously moving object on a screen, a viewer's visual line also continuously moves with the object's motion. Thus, the visual line may collide with the discrete display scheme of the display device to cause screen blurring. For example, when it is assumed that the display device displays an object stopping at a location A in a first frame and displays the object stopping at a location B in a second frame, the viewer's visual line moves along a predicted route that the object will take, ranging from location A to location B. However, the object may not be displayed in an intermediate location between locations A and B.

Consequently, luminance identified by the viewer in the first frame is the value obtained by integrating the luminance of pixels existing in the route from location A to location B, that is, luminance is a value obtained by appropriately averaging the luminance of the object and luminance of the background. Thus, the object appears blurred.

Also, a pixel of an organic light emitting device includes an organic light emitting element and a thin film transistor (TFT) that drives the organic light emitting element. When operating these for a long time, a threshold voltage and mobility may change so that a predicted luminance may not be obtained. Particularly, when characteristics of semiconductors included in TFTs are not uniform throughout the display device, a luminance deviation may occur between the pixels.

SUMMARY OF THE INVENTION

The present invention provides a display device that compensates for a field effect mobility and a threshold voltage of a driving transistor to prevent an image from appearing blurred.

Additional features of the invention will be set forth in the description which follows, and in part will be apparent from the description, or may be learned by practice of the invention.

The present invention provides a display device including a light emitting device, a capacitor connected between a first electrical contact and a second electrical contact, a driving transistor including an input terminal that is connected to a driving voltage, an output terminal connected to the second electrical contact, and a control terminal connected to the first electrical contact. The display device also includes a switching transistor operating in response to a scanning signal to be connected between a data voltage and the first electrical contact, a first compensation transistor operating in response to a first compensation signal and connected between the first electrical contact and a first voltage, and a second compensation transistor operating in response to a second compensation signal and connected between the second electrical contact and a second voltage.

The present invention also provides a method of driving a display device including a light emitting device, a capacitor connected between a first electrical contact and a second electrical contact, a switching transistor to transmit a data voltage to the first electrical contact, a first compensation transistor to transmit a first voltage to the first electrical contact, a second compensation transistor to transmit a second voltage to the second electrical contact, and a driving transistor including a control terminal connected to the first electrical contact. The method includes connecting the first electrical contact to the first voltage and connecting the second electrical contact to the second voltage, disconnecting the second electrical contact from the second voltage and charging the capacitor with a threshold voltage of the driving transistor to compensate a threshold voltage, connecting the first electrical contact to the data voltage and changing a voltage of the second electrical contact to compensate a field effect mobility, and disconnecting the first electrical contact from the data voltage to flow a driving current in the light emitting device.

The present invention also provides a method of driving a display device including a light emitting device, a capacitor connected between a first electrical contact and a second electrical contact, a switching transistor operating in response to a scanning signal, a first compensation transistor operating in response to a first signal, a second compensation transistor controlled by a second signal, and a driving transistor including a control terminal connected to the first electrical contact. The method includes turning on the first compensation transistor and the second compensation transistor while the switching transistor is off, turning on the first compensation transistor and turning off the second compensation transistor to compensate a threshold voltage, turning on the switching transistor and turning off the first and the second compensation transistor to compensate a field effect mobility, and turning off the switching transistor and the first and second compensation transistors to emit light.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
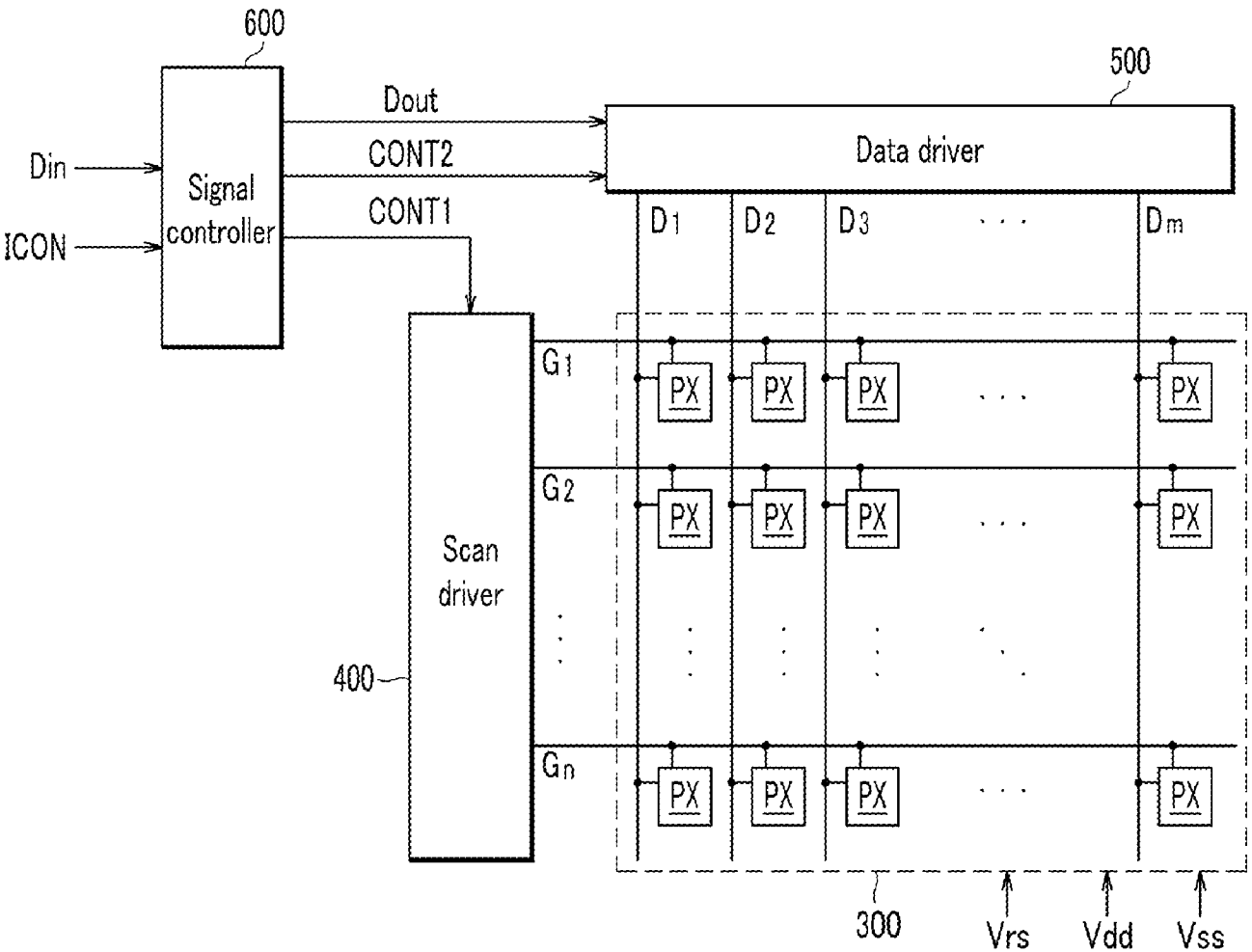
FIG. 1 is a block diagram of an organic light emitting device according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

Hereinafter, an organic light emitting device according to an exemplary embodiment of the present invention will be described with reference to FIG. 1 and FIG. 2.

Figure 2:
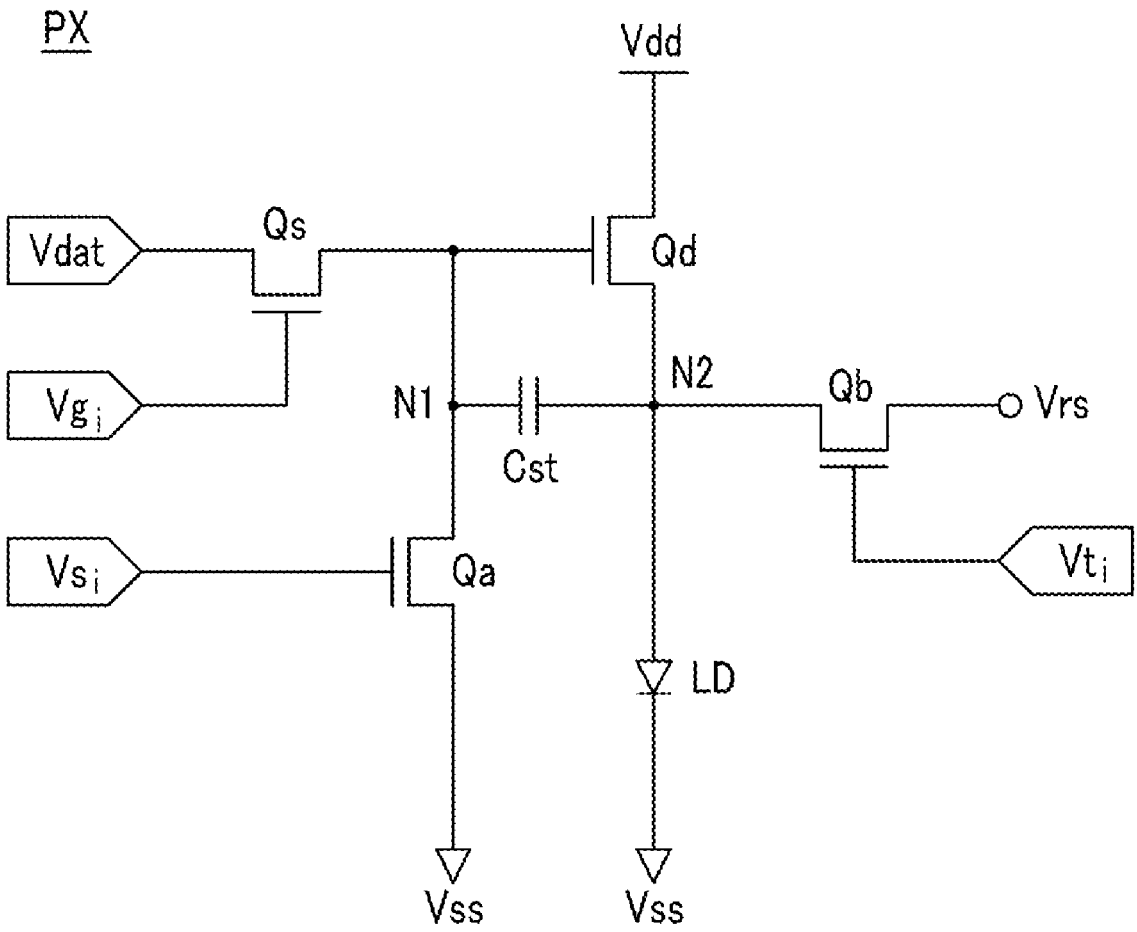
FIG. 2 is an equivalent circuit diagram of a single pixel in an organic light emitting device according to an exemplary embodiment of the present invention.

FIG. 1 is a block diagram of an organic light emitting device according to an exemplary embodiment of the present invention, and FIG. 2 is an equivalent circuit diagram of a single pixel in an organic light emitting device according to an exemplary embodiment of the present invention.

Referring to FIG. 1, the organic light emitting device according to an exemplary embodiment of the present invention includes a display panel 300, a scan driver 400, a data driver 500, and a signal controller 600.

The display panel 300 may include a plurality of signal lines $G_1$-$G_n$ and $D_1$-$D_m$, a plurality of voltage lines (not shown), and a plurality of pixels PX that are connected thereto and are arranged in a matrix.

The signal lines $G_1$-$G_n$ and $D_1$-$D_m$ include a plurality of scanning signal lines $G_1$-$G_n$ to transmit scanning signals, a plurality of first and second compensation signal lines (not shown) to transmit first and second compensation signals, respectively, and a plurality of data lines $D_1$-$D_m$ to transmit data signals. The scanning signal lines $G_1$-$G_n$ extend approximately in a row and are substantially parallel with each other, and the data lines $D_1$-$D_m$ extend approximately in a column and are substantially parallel with each other.

The voltage line includes a driving voltage line (not shown) to transmit a driving voltage, a common voltage line (not shown) to transmit a common voltage Vss, and a reset voltage line (not shown) to transmit a reset voltage Vrs.

As shown in FIG. 2, each pixel PX includes an organic light emitting element LD, a driving transistor Qd, a capacitor Cst, a switching transistor Qs, and first and second compensation transistors Qa and Qb.

The driving transistor Qd includes an output terminal, an input terminal, and a control terminal. The control terminal of the driving transistor Qd may be connected to the switching transistor Qs, the input terminal may be connected to the driving voltage Vdd, and the output terminal may be connected to the organic light emitting element LD at an electrical contact N2.

One terminal of the capacitor Cst is connected to the first compensation transistor Qa at an electrical contact N1, and the other terminal of the capacitor Cst is connected to the second compensation transistor Qb at the electrical contact N2. While current flows in the organic light emitting element LD, the capacitor Cst may charge a voltage difference between the control terminal and the output terminal of the driving transistor Qd and maintain the charged voltage difference even after the switching transistor Qs is turned off.

Although shown as separate elements in the drawings, the electrical contacts N1 and N2 are not necessarily separate elements. For example, the electrical contact N1 may be one electrode of the capacitor Cst integrally formed with the control terminal of the driving transistor Qd, and the electrical contact N2 may be the other electrode of the capacitor Cst integrally formed with the output terminal of the driving transistor Qd. Thus, the schematic circuit diagrams are included to show how pixel elements are connected rather than an actual physical structure of those elements.

The switching transistor Qs also includes an output terminal, an input terminal, and a control terminal. The control terminal is connected to a scanning signal line $G_i$ to receive a scanning signal $Vg_i$ where i=1, 2, . . . , N, the input terminal is connected to a data line $D_1$-$D_m$ to receive a data voltage Vdat, and the output terminal is connected to the driving transistor Qd. In response to the scanning signal $Vg_i$ where i=1, 2, . . . , N, the switching transistor Qs may transmit the data voltage Vdat to the control terminal of the driving transistor Qd.

The first compensation transistor Qa is connected between the electrical contact N1 and the common voltage Vss, and it may transmit the common voltage Vss to the electrical contact N1 in response to the first compensation signal $Vs_i$.

The second compensation transistor Qb is connected between the electrical contact N2 and the reset voltage Vrs, and it may transmit the reset voltage Vrs to the electrical contact N2 in response to the second compensation signal $Vt_i$.

The switching transistor Qs, the first and second compensation transistors Qa and Qb, and the driving transistor Qd may be n-channel field effect transistors (FETs). Examples of the field effect transistor may include a thin film transistor (TFT), which may include polysilicon or amorphous silicon. Channel types of the switching transistor Qs, the first and second compensation transistors Qa and Qb, and the driving transistor Qd may be reversed. In this case, waveforms of signals driving them may also be reversed.

The organic light emitting element LD, which may be an organic light emitting diode (OLED), includes an anode that is connected to the output terminal of the driving transistor Qd and a cathode that is connected to the common voltage Vss. The organic light emitting element LD may display an image if a current $I_{LD}$ is supplied by the driving transistor Qd. The organic light emitting element LD may emit light having an intensity that depends on the magnitude of the current $I_{LD}$ supplied by the driving transistor Qd. The magnitude of the current $I_{LD}$ generally depends on the voltage between the control terminal and the input terminal of the driving transistor Qd.

Referring to FIG. 1, the scan driver 400 is connected to the scanning signal lines $G_1$-$G_n$ of the display panel 300 and the first and second compensation signal lines (not shown). The scan driver 400 applies the scanning signals $Vg_i$, which include a combination of a high voltage Von and low voltage Voff, to the scanning signal lines $G_1$-$G_n$. The scan driver 400 also applies the first and second compensation signals $Vs_i$ and $Vt_i$, which include the combination of the high voltage Von and the low voltage Voff, to the first and second compensation signal lines (not shown). Alternatively, the first compensation signal line (not shown) or the second compensation signal line (not shown) may be connected to a separately provided first compensation driver (not shown) or second compensation driver (not shown) to thereby receive the first compensation signal $Vs_i$ or the second compensation signal $Vt_i$, which includes the combination of the high voltage Von and the low voltage Voff.

The data driver 500 is connected to the data lines $D_1$-$D_m$ of the display panel 300 to apply data voltages Vdat, representing image signals, to the data lines $D_1$-$D_m$.

The signal controller 600 controls operations of the scan driver 400 and the data driver 500.

Each of the driving devices 400, 500, and 600 may be directly installed on the display panel 300 in a form of at least one IC chip, may be installed on a flexible printed circuit film (not shown) to be attached to the display panel 300 in the form of a tape carrier package (TCP), or may be installed on a separate printed circuit board (PCB) (not shown). Alternatively, driving devices 400, 500, and 600 may be integrated in the display panel 300 together with the signal lines $G_1$-$G_n$ and $D_1$-$D_m$ and the transistors Qs, Qa, Qb, and Qd, etc. Also, the above driving devices 400, 500, and 600 may be integrated into a single chip. In this case, at least one of them or at least one circuit element constituting them may be positioned outside the single chip.

Hereinafter, a display operation of the organic light emitting device as described above will be described with reference to FIG. 3, FIG. 4, FIG. 5, FIG. 6, and FIG. 7, and also FIG. 1 and FIG. 2.

Figure 3:
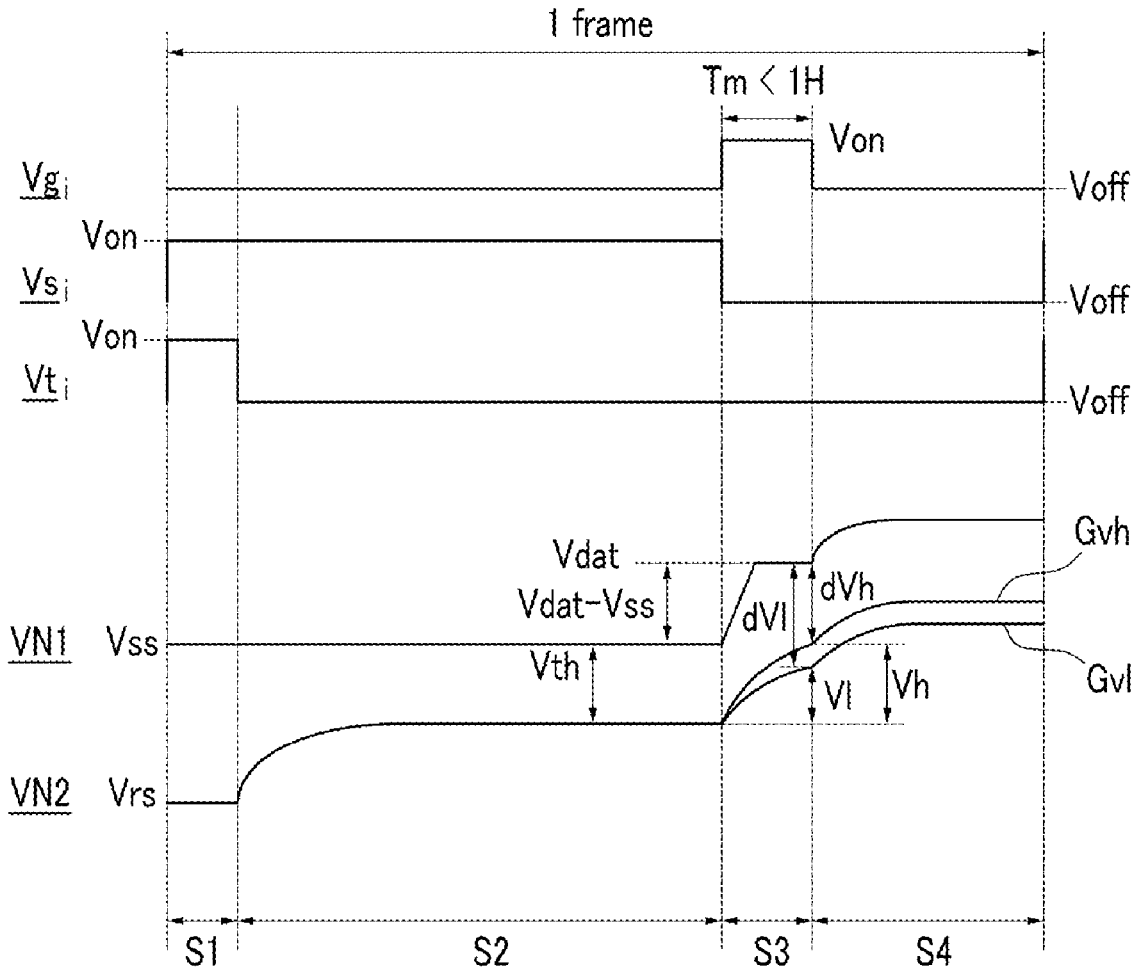
FIG. 3 is a waveform illustrating a driving signal applied to a pixel of a single row and a voltage at an electrical contact in an organic light emitting device according to an exemplary embodiment of the present invention.

FIG. 3 is a waveform illustrating a driving signal applied to a pixel of a single row and a voltage at an electrical contact N1 or N2 in an organic light emitting device according to an exemplary embodiment of the present invention, and FIG. 4, FIG. 5, FIG. 6, and FIG. 7 are equivalent circuit diagrams of a single pixel in periods S1, S2, S3, and S4, respectively, of FIG. 3.

The signal controller 600 may receive, from an external graphics controller (not shown), an input image signal Din, and an input control signal ICON for controlling display of the input image signal Din. The input image signal Din contains information associated with luminance of each pixel Px. The luminance includes a predetermined number of grays, for example $1{,}024=2^{10}$, $256=2^8$, or $64=2^6$. Examples of the input control signal ICON may include a vertical synchronization signal, a horizontal synchronizing signal, a main clock signal, a data enable signal, etc.

The signal controller 600 may appropriately process the input image signal Din to be suitable for an operating condition of the display panel 300 based on the input image signal Din and the input control signal ICON, and may generate a scan control signals CONT1, a data control signal CONT2, etc. The signal controller 600 may output the scan control signal CONT1 to the scan driver 400, and may output the data control signal CONT2 and an output image signal Dout to the data driver 500.

The scan control signals CONT1 may include a scanning start signal for instructing a start of scanning the high voltage Von to the scanning signal lines $G_1$-$G_n$, at least one clock signal for controlling an output period of the high voltage Von, an output enable signal for defining a duration time of the high voltage Von, etc.

The data control signal CONT2 may include a horizontal synchronization start signal for informing the start of transmission of the digital image signal Dout for pixels Px in a row, a load signal for instructing application of analog data voltages to the data lines $D_1$-$D_m$, a data clock signal, etc.

The scan driver 400 sequentially changes the scanning signals $Vg_i$, which are applied to the scanning signal lines $G_1$-$G_n$ according to the scan control signal CONT1 from the signal controller 600, to the high voltage Von and then again to the low voltage Voff.

According to the data control signal CONT2 from the signal controller 600, the data driver 500 may receive the digital output image signals Dout with respect to the pixels Px of each row, convert the output image signal Dout to analog data voltages Vdat, and then apply the converted analog data voltages Vdat to the data lines $D_1$-$D_m$.

Hereinafter, each operation will be described based on a particular pixel row, for example an $i^{th}$ row, during a single frame, where a scanning signal is applied to all the scanning signal lines $G_1$-$G_n$.

Referring to FIG. 3, while the scanning signal $Vg_i$ applied to the scanning signal line $G_i$ is the low voltage Voff, the compensation signal $Vs_i$ applied to the first compensation signal line (not shown) is the high voltage Von, and another compensation signal $Vt_i$ applied to the second compensation signal line (not shown) is also the high voltage Von (a reset period S1).

Figure 4:
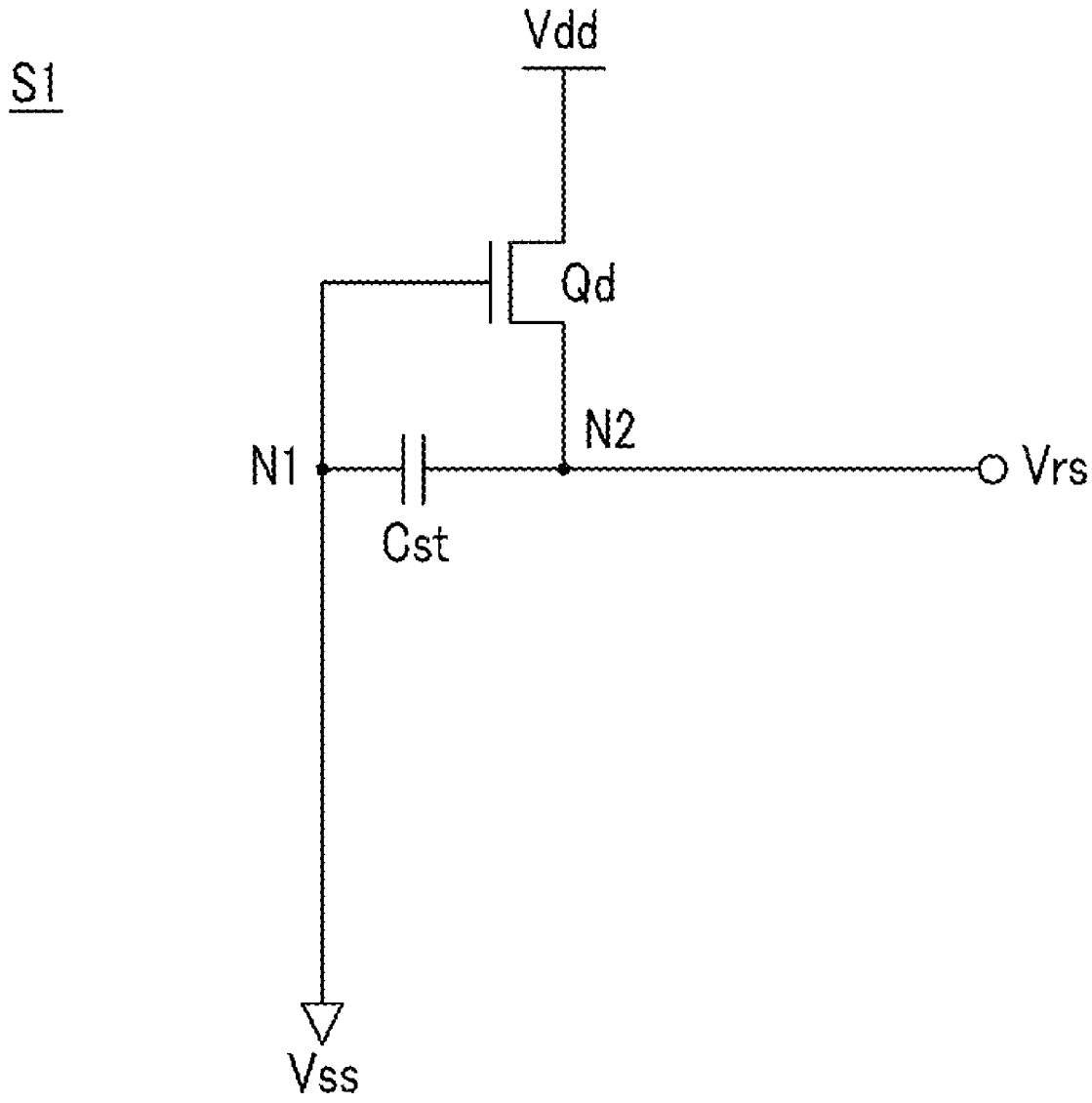
FIG. 4, FIG. 5, FIG. 6, and FIG. 7 are equivalent circuit diagrams of a single pixel in periods S1, S2, S3, and S4, respectively, of FIG. 3.

Then, as shown in FIG. 4, in a state where the switching transistor Qs is turned off, the first compensation transistor Qa and the second compensation transistor Qb are turned on whereby the common voltage Vss is applied to the first electrical contact N1 and the reset voltage Vrs is applied to the second electrical contact N2. Here, a voltage equal to a voltage difference between the common voltage Vss and the reset voltage Vrs is charged in the capacitor Cst. A current from the driving transistor Qd exits through a terminal supplying the reset voltage Vrs.

Next, referring to FIG. 3, the scan driver 400 changes the second compensation signal $Vt_i$, which is applied to the second compensation signal line (not shown), to the low voltage Voff (a threshold voltage compensating period S2).

Figure 5:
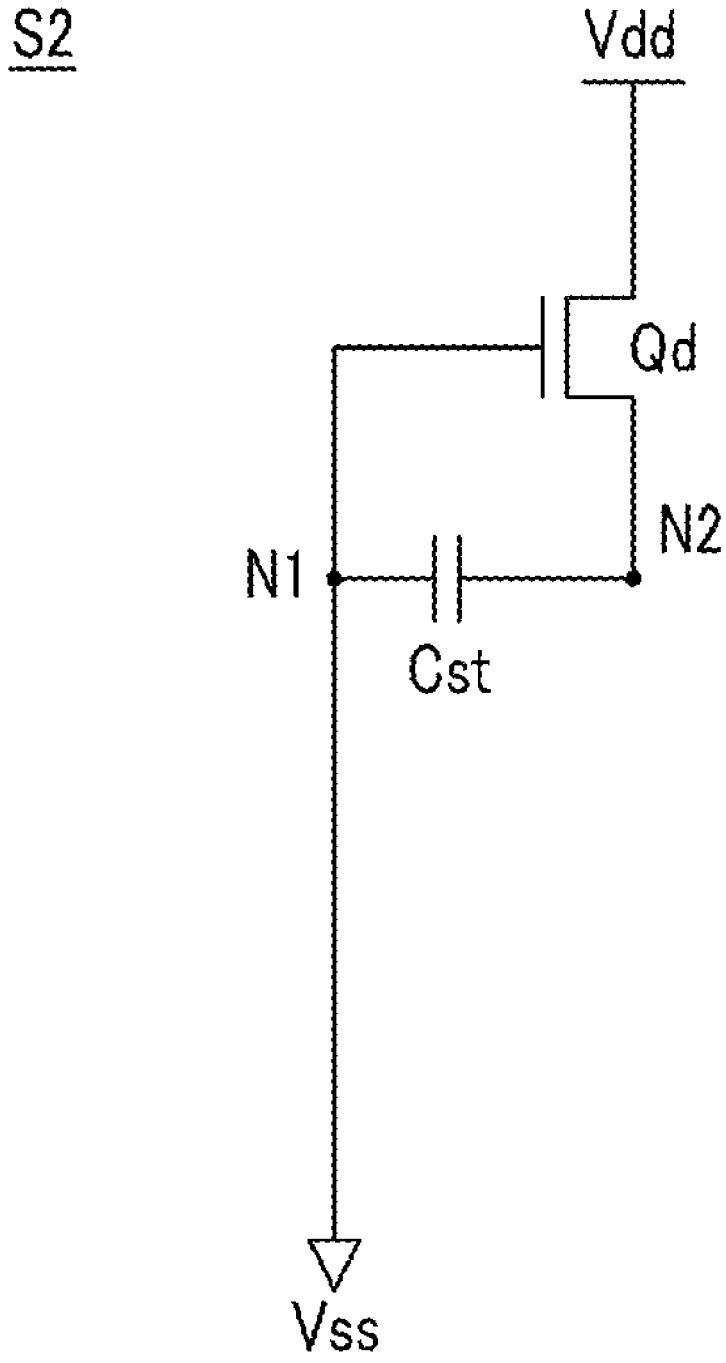

Then, as shown in FIG. 5, where the first compensation transistor Qa maintains a turned on state, the second compensation transistor Qb is turned off and the driving transistor Qd flows a current to the electrical contact N2. Here, when a voltage difference between the electrical contacts N1 and N2, that is, the voltage difference between the control terminal and the output terminal of the driving transistor Qd reaches a threshold voltage Vth of the driving transistor Qd, the driving transistor Qd turns off whereby the threshold voltage Vth of the driving transistor Qd is stored in the capacitor Cst. Specifically, the voltage at the electrical contact N1 is maintained at the common voltage Vss, whereas the voltage at the electrical contact N2 increases until the voltage difference between the electrical contacts N1 and N2 reaches the threshold voltage Vth of the driving transistor Qd. Accordingly, it is possible to compensate the threshold voltages Vth of the driving transistors Qd to thereby prevent influences caused by deviations of the threshold voltages Vth of the driving transistors Qd.

Referring to FIG. 3, in a state where the second compensation signal $Vt_i$ is the low voltage Voff, the scan driver 400 changes the scanning signal $Vg_i$, which is applied to the scanning signal line $G_i$, to the high voltage Von and changes the first compensation signal $Vs_i$, which is applied to the first compensation signal line (not shown), to the low voltage Voff (a compensating period S3 of the field effect mobility). A period of time when the high voltage Von of the scanning signal $Vg_i$ is applied to the scanning signal line $G_i$, that is, a mobility compensation time Tm, is less than a single horizontal period ("1H" denoting a single period of a horizontal synchronizing signal and a data enable signal).

Figure 6:
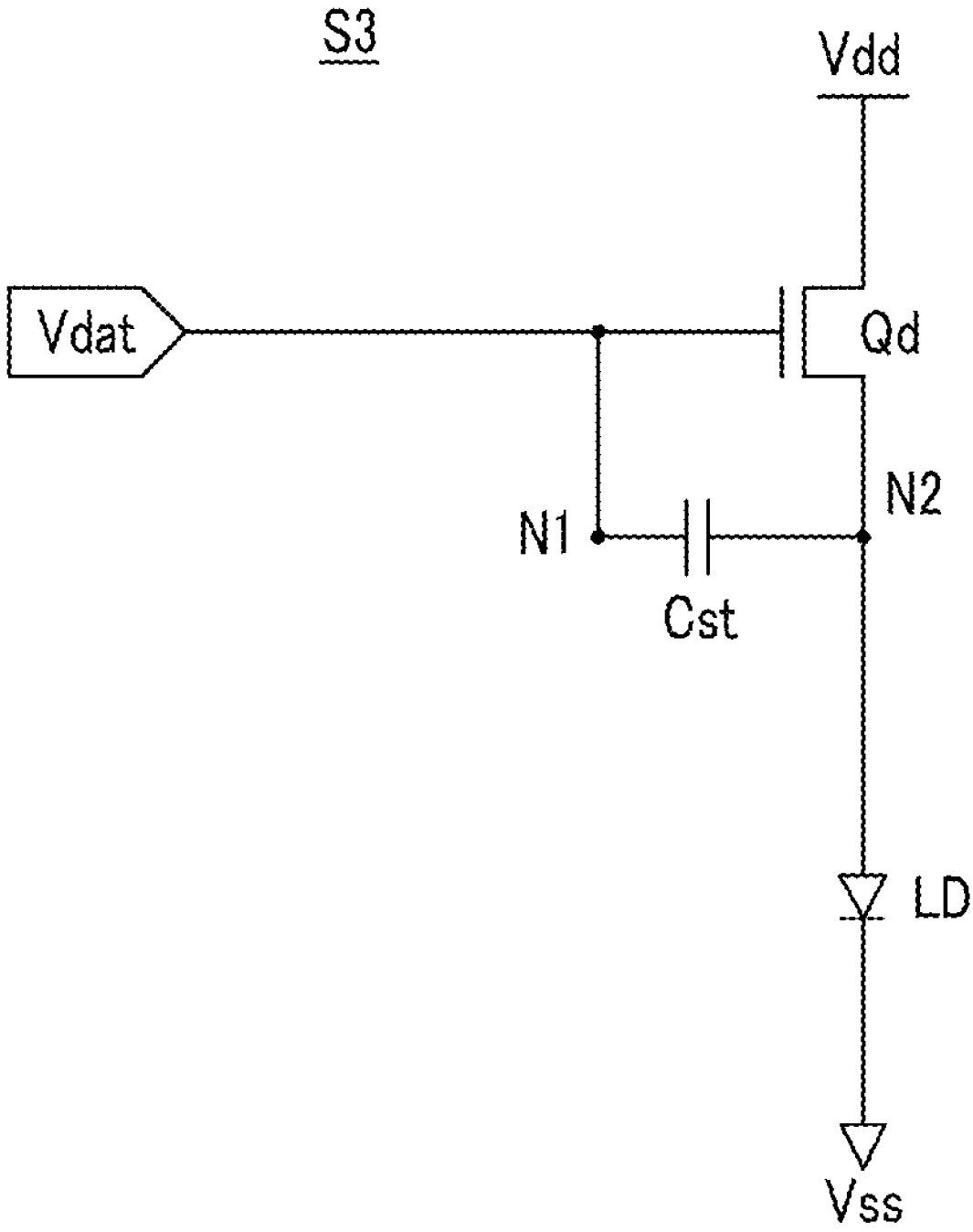

Then, as shown in FIG. 6, the electrical contact N1 is disconnected from the common voltage Vss and the switching transistor Qs turns on, thereby applying the data voltage Vdat to the electrical contact N1. Consequently, the voltage at the electrical contact N1 reaches the data voltage Vdat within the mobility compensation time Tm. Also, the voltage at the electrical contact N2 connected to the organic light emitting element LD with a larger capacitance slowly increases, and the speed of increase differs depending on the field effect mobility of the driving transistor Qd. When the field effect mobility is large, the voltage at the electrical contact N2 increases more quickly, as shown by the curved voltage line Gvh in FIG. 3. Conversely, when the field effect mobility is small, the voltage at the electrical contact N2 rises more slowly, as shown by the curved voltage line Gvl in FIG. 3.

Therefore, as shown in FIG. 3, after the mobility compensation time Tm elapses, the voltage difference Vgs between the two electrical contacts N1 and N2, that is, the voltage difference between the control terminal and the output terminal of the driving transistor Qd, corresponds to dVh when the field effect mobility of the driving transistor Qd is large and to dVl when the field effect mobility is small.

The mobility compensating period S3 and the threshold voltage compensating period S2 will be further described in detail with reference to FIGS. 8 and 9.

Figure 8:
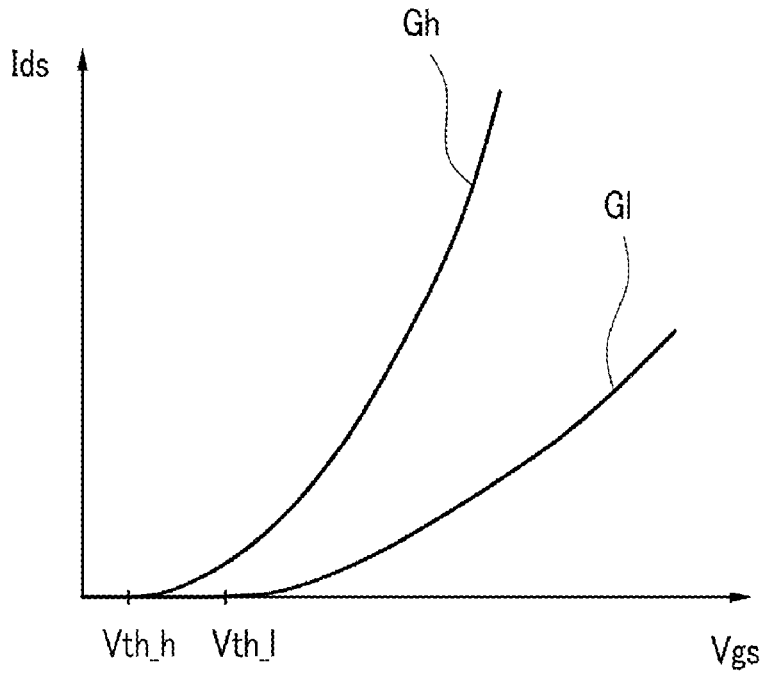
FIG. 8 shows current-voltage curves of driving transistors with different threshold voltages and field effect mobilities.
Figure 9:
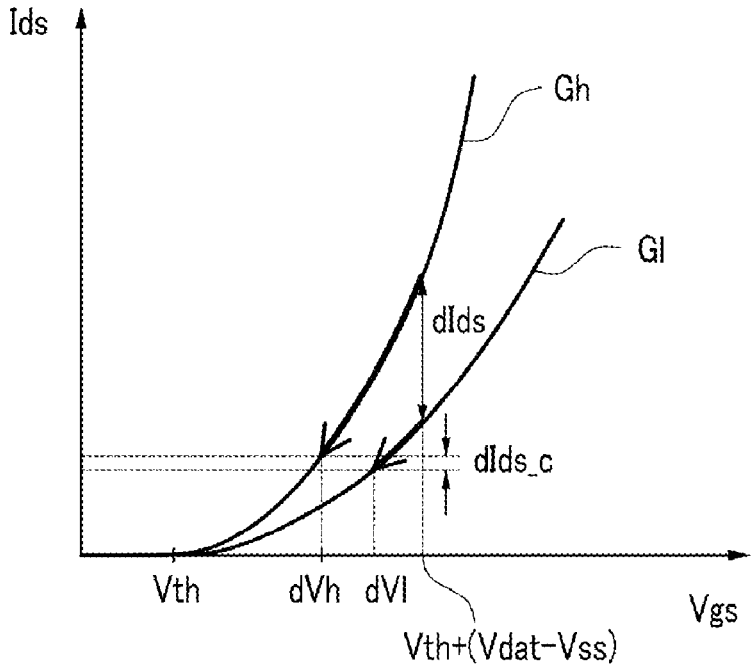
FIG. 9 shows current-voltage curves of driving transistors with different field effect mobilities after compensating a threshold voltage.

FIG. 8 shows current-voltage curves Gh and Gl of driving transistors with different threshold voltages Vth and field effect mobilities, and FIG. 9 shows current-voltage curves Gh and Gl of driving transistors with different field effect mobilities after compensating a threshold voltage.

Referring to FIG. 8, the field effect mobilities and the threshold voltages Vth_h and Vth_l of the two driving transistors Qd are different from each other. In the threshold voltage compensating period S2 of FIG. 3, the voltage difference Vgs between two electrical contacts N1 and N2 reaches the threshold voltages Vth_h and Vth_l of the two driving transistors Qd, respectively, which results in compensating the threshold voltages Vth_h and Vth_l of the two driving transistors Qd, as shown in FIG. 9. Specifically, output currents Ids of the two driving transistors Qd are barely affected by the different threshold voltages Vth-h and Vth_l thereof, which creates the effect that the driving transistors Qd have the same threshold voltage Vth.

Next, while the data voltage Vdat is applied to the electrical contact N1 in the mobility compensating period S3, the voltage VN1 of the electrical contact N1 increases up to the data voltage Vdat.

At the same time, the voltage at the electrical contact N2 also increases at a different rate according to the field effect mobility of the respective driving transistor Qd. Consequently, the voltage difference Vgs between the two electrical contacts N1 and N2 may be expressed as the following Equation 1, or as shown in FIG. 9.

$$Vgs=Vth+(Vdat-Vss)-Vh=dVh \text{ (when the field effect mobility is larger)}$$

$$Vgs=Vth+(Vdat-Vss)-Vl=dVl \text{ (when the field effect mobility is smaller)} \quad \text{(Equation 1)}$$

Here, Vh and Vl correspond to voltage increases at the electrical contact N2 with a large field effect mobility and a small field effect mobility, respectively, in the mobility compensating period S3 (see FIG. 3). Thus, the greater the field effect mobility is, the greater the voltage increase at the electrical contact N2 is. Accordingly, as shown in FIG. 3, a voltage difference Vgs between the two electrical contacts N1 and N2 when the field effect mobility is larger (Gvh) is less than a voltage difference Vgs between the two electrical contacts N1 and N2 when the field effect mobility is smaller (Gvl). In the mobility compensating period S3, the greater the field effect mobility is, the smaller the voltage difference between the two electrical contacts N1 and N2 becomes. Therefore, as shown in FIG. 9, a deviation dIds of an output current between driving transistors Qd is large before the mobility compensating period S3, whereas a deviation dIds_c of the output current decreases after the mobility compensating period S3. Through this, it is possible to compensate the deviation of the field effect mobility among the driving transistors Qd and thereby reduce the deviation of the output current Ids of the driving transistors Qd. The length of the mobility compensation time Tm may be adjusted according to characteristics of the organic light emitting device and the field effect mobility of the driving transistor Qd.

Next, as shown in FIG. 3, the scan driver 400 changes the scanning signal $Vg_i$ to the low voltage Voff to thereby turn off the switching transistor Qs (during the light emitting period S4). The first and second compensation signals $Vs_i$ and $Vt_i$ still maintain the low voltage Voff in period S4.

Figure 7:
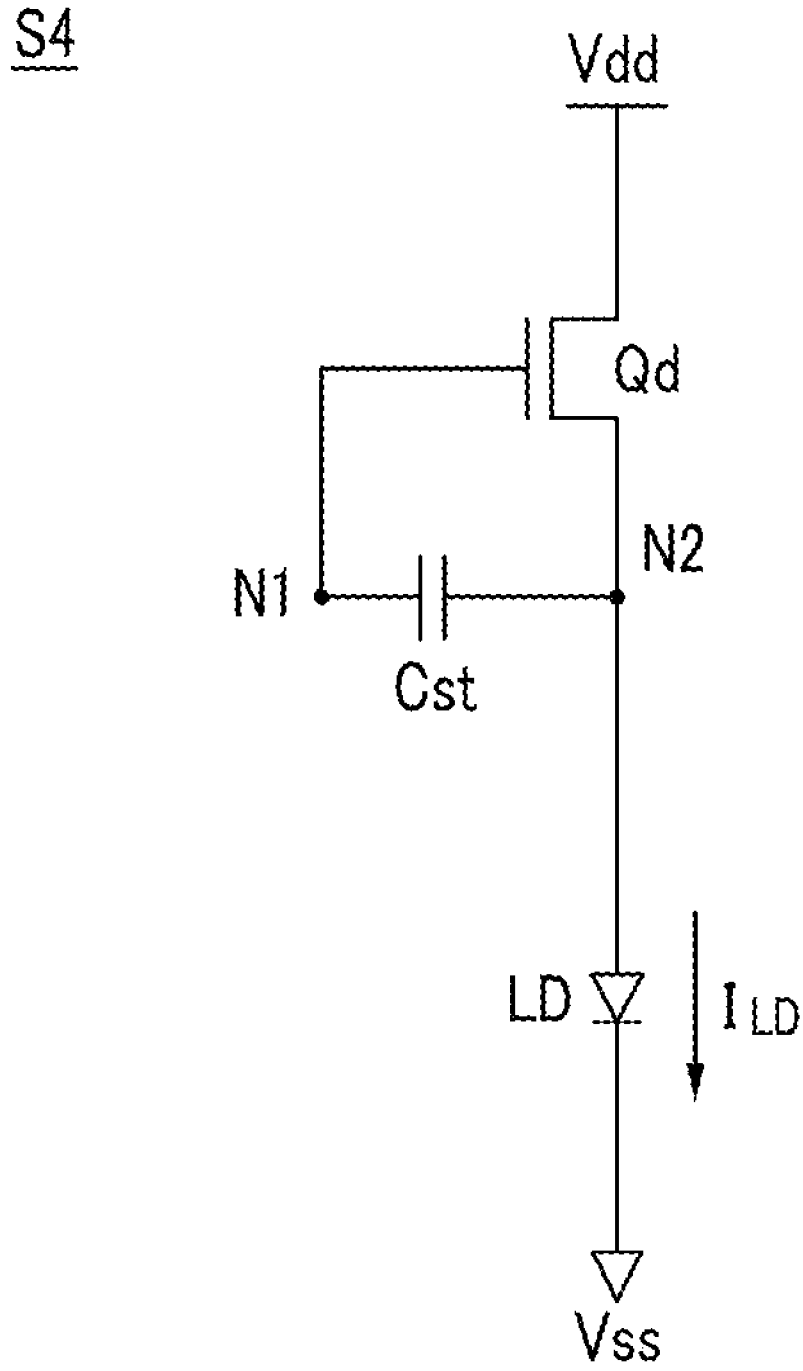

Then, as shown in FIG. 7, the electrical contact N1 is disconnected from the data voltage Vdat to float and the driving transistor Qd maintains a turned-on state. The voltage difference between the two electrical contacts N1 and N2 increases until a current $I_{LD}$ flows in the organic light emitting element LD, and is uniformly maintained by the capacitor Cst. The output current $I_{LD}$ that is output from the driving transistor Qd and flows to the organic light emitting element LD is controlled by the voltage difference Vgs between the control terminal and the output terminal of the driving transistor Qd.

$$I_{LD}=K\times\mu\times(Vgs-Vth)^2 \quad \text{(Equation 2)}$$

In this instance, K denotes a constant according to characteristics of the driving transistor Qd, such that $K=1/2\cdot Ci\cdot W/L$, μ denotes a field effect mobility, Ci denotes a capacity of a gate insulating layer, W denotes a channel width of the driving transistor Qd, and L denotes a channel length of the driving transistor Qd.

In Equation 2, the voltage difference between two electrical contacts N1 and N2, that is, the voltage difference Vgs between the control terminal and the output terminal of the driving transistor Qd, corresponds to a value where all the threshold voltage Vth and the field effect mobility μ are compensated in the threshold voltage compensating period S2 and the mobility compensating period S3.

The output current $I_{LD}$ is supplied to the organic light emitting element LD. The organic light emitting element LD emits light having an intensity that varies according to the magnitude of the output current $I_{LD}$ to thereby display an image.

As described above, according to an exemplary embodiment of the present invention, although deviation exists in the threshold voltage Vth and the field effect mobility μ among driving transistors Qd, or the magnitude of the field effect mobility μ and the threshold voltage Vth of each driving transistor Qd changes over time, it is possible to display a uniform image without the need to add an additional driver or driving method.

Also, all the periods S1 through S4 are distributed over a single frame, and thus it is possible to more accurately and flexibly compensate the threshold voltage and the field effect mobility. In addition, it is possible to readily cope with the large screen of a display device. Particularly, since a period of time for the threshold voltage compensating period is long, it is possible to compensate the threshold voltage more accurately.

Furthermore, since the organic light emitting element LD does not emit light in the reset period S1, the threshold voltage compensating period S2, and the mobility compensating period S3 of the single frame, the pixel Px is black, and consequently, it is possible to prevent an image from appearing blurred even when displaying a motion picture.

According to the above-described exemplary embodiments of the present invention, it is possible to display a uniform image by compensating a field effect mobility and a threshold voltage of a driving transistor to prevent an image from appearing blurred.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display device comprising:

a light emitting device;

a capacitor connected between a first electrical contact and a second electrical contact;

a driving transistor comprising an input terminal directly connected to a driving voltage, an output terminal connected to the second electrical contact, and a control terminal connected to the first electrical contact;

a switching transistor operating in response to a scanning signal to provide a data voltage to the first electrical contact;

a first compensation transistor operating in response to a first compensation signal and connected between the first electrical contact and a first voltage; and a second compensation transistor operating in response to a second compensation signal and connected between the second electrical contact and a second voltage, wherein the first compensation signal transits from a high voltage to a low voltage simultaneously with a transition of the scanning signal from a low voltage to a high voltage.

2. The display device of claim 1, wherein a voltage difference between the first voltage and the second voltage is stored in the capacitor while the first electrical contact is connected to the first voltage and the second electrical contact is connected to the second voltage.

3. The display device of claim 2, wherein after the voltage difference between the first voltage and the second voltage is stored in the capacitor, the first electrical contact is connected to the first voltage and a threshold voltage of the driving transistor is stored in the capacitor.

4. The display device of claim 3, wherein the second electrical contact is disconnected from the second voltage while the first electrical contact is connected to the first voltage.

5. The display device of claim 3, wherein after the threshold voltage of the driving transistor is stored in the capacitor, the first electrical contact is connected to the data voltage and the second electrical contact is disconnected from the second voltage.

6. The display device of claim 5, wherein the data voltage changes every one horizontal period, and a period of time when the first electrical contact is connected to the data voltage is less than a period of time of the one horizontal period.

7. The display device of claim 6, wherein while the first electrical contact is connected to the data voltage, the greater a field effect mobility of the driving transistor, the more a voltage of the second electrical contact changes.

8. The display device of claim 5, wherein, after the first electrical contact is connected to the data voltage, the switching transistor, the first compensation transistor, and the second compensation transistor are turned off, the capacitor maintains a uniform charge voltage, and a driving current flows in the light emitting device.

9. The display device of claim 8, wherein, while the switching transistor and the first compensation transistor and the second compensation transistor are turned off, the greater a field effect mobility of the driving transistor, the less the charge voltage of the capacitor is.

10. The display device of claim 1, further comprising:

a scan driver to generate the scanning signal, the first compensation signal, and the second compensation signal;

a data driver to generate the data voltage; and a plurality of pixels to receive the data voltage in response to the scanning signal to display a luminance corresponding to the data voltage.

11. The display device of claim 10, wherein a field effect mobility and a threshold voltage of the driving transistor are compensated for a single frame when the scan signal is transmitted to all of the plurality of pixels.

12. The display device of claim 1, further comprising:

a scan driver to generate the scanning signal;

a data driver to generate the data voltage;

a compensation driver to generate the first compensation signal and the second compensation signal; and a plurality of pixels to receive the data voltage according to the scanning signal to display a luminance corresponding to the data voltage.

13. A method of driving a display device comprising a light emitting device, a capacitor connected between a first electrical contact and a second electrical contact, a switching transistor to transmit a data voltage to the first electrical contact, a first compensation transistor to transmit a first voltage to the first electrical contact, a second compensation transistor to transmit a second voltage to the second electrical contact, and a driving transistor comprising a control terminal connected to the first electrical contact and an input terminal directly connected to a driving voltage, the method comprising:

connecting the first electrical contact to the first voltage and connecting the second electrical contact to the second voltage during a first time period;

disconnecting the second electrical contact from the second voltage and charging the capacitor with a threshold voltage of the driving transistor to compensate a threshold voltage during a second time period, wherein a voltage level of the driving voltage at the input terminal of the driving transistor is substantially constant during the first and second time periods;

connecting the first electrical contact to the data voltage and simultaneously starting changing a voltage of the second electrical contact to compensate a field effect mobility; and disconnecting the first electrical contact from the data voltage and disconnecting the second electrical contact from the second voltage to flow a driving current in the light emitting device.

14. The method of claim 13, wherein, the connecting of the first electrical contact to the first voltage and connecting of the second electrical contact to the second voltage comprises turning on the first compensation transistor and the second compensation transistor.

15. The method of claim 13, wherein, the disconnecting of the second electrical contact from the second voltage and charging the capacitor with the threshold voltage of the driving transistor comprises turning off the second compensation transistor while the first compensation transistor is on.

16. The method of claim 13, wherein, in connecting the first electrical contact to the data voltage and changing the voltage of the second electrical contact, the greater a field effect mobility of the driving transistor, the more a voltage of the second electrical contact changes.

17. The method of claim 13, wherein, in connecting the first electrical contact to the data voltage and changing the voltage of the second electrical contact, a period of time when the voltage of the second electrical contact changes is less than a single horizontal period.

18. The method of claim 13, wherein, in disconnecting the first electrical contact from the data voltage and disconnecting of the second electrical contact from the second voltage, the greater a field effect mobility of the driving transistor is, the less a voltage stored in the capacitor.

19. A method of driving a display device comprising a light emitting device, a capacitor connected between a first electrical contact and a second electrical contact, a switching transistor operating in response to a scanning signal, a first compensation transistor operating in response to a first signal, a second compensation transistor operating in response to a second signal, and a driving transistor comprising a control terminal connected to the first electrical contact and an input terminal directly connected to a driving voltage, the method comprising:

turning on the first compensation transistor and the second compensation transistor and turning off the switching transistor to initialize during a first time period;

turning on the first compensation transistor and turning off the second compensation transistor to compensate a threshold voltage during a second time period, wherein a voltage level of the driving voltage at the input terminal of the driving transistor is substantially constant during the first and second time periods;

turning on the switching transistor and simultaneously turning off the first compensation transistor while the second compensation transistor is turned off to compensate a field effect mobility; and turning off the switching transistor, the first compensation transistor and the second compensation transistor to emit light.

20. The method of claim 19, wherein, in turning on the first compensation transistor and the second compensation transistor and turning off the switching transistor, the first signal and the second signal are in an on state and the scanning signal is in an off state.

21. The method of claim 19, wherein, in turning on of the first compensation transistor and turning off of the second compensation transistor, the first signal is in an on state and the second signal and the scanning signal are in an off state.

22. The method of claim 19, wherein, in turning on the switching transistor and turning off the first compensation transistor and the second compensation transistor, the first signal and the second signal are in an off state and the scanning signal is in an on state.

23. The method of claim 19, wherein, in turning off the switching transistor, the first compensation transistor and the second compensation transistor, the first signal, the second signal, and the scanning signal are in an off state.

* * * * *